US006005180A

United States Patent [19]

Masuda

[11] Patent Number: 6,005,180

[45] Date of Patent: Dec. 21, 1999

[54] MUSIC AND GRAPHIC APPARATUS AUDIO-VISUALLY MODELING ACOUSTIC INSTRUMENT

[75] Inventor: Hideyuki Masuda, Hamamatsu, Japan

[73] Assignee: Yamaha Corporation, Hamamatsu, Japan

[21] Appl. No.: 09/138,220

[22] Filed: Aug. 21, 1998

[30] Foreign Application Priority Data

Aug. 21, 1997 [JP] Japan ..... 9-224732

[51] Int. Cl.[6] ..... C10H 7/00

[52] U.S. Cl. ..... 84/622; 84/659

[58] Field of Search ..... 84/622, 659

[56] References Cited

U.S. PATENT DOCUMENTS 5,027,689 7/1991 Fujimori .
5,220,117 6/1993 Yamada et al. .
5,276,272 1/1994 Masuda .
5,585,583 12/1996 Owen .

FOREIGN PATENT DOCUMENTS 9-160575 6/1997 Japan .

*Primary Examiner*—Jeffrey Donels
*Attorney, Agent, or Firm*—Graham & James LLP

[57] ABSTRACT

In a music and graphic apparatus, a performance input device provides performance information effective to control generation of a music sound. A timbre input device provides timbre information effective to specify a timbre of the music sound. A sound source is operative based on the timbre information to simulate an acoustic instrument capable of creating the specified timbre. The sound source is responsive to the performance information to generate the music sound as if voiced by the acoustic instrument with the specified timbre. A model image generator generates a model image graphically representing at least a part of the acoustic instrument. A dynamic image generator is operative according to the performance information for generating a dynamic image graphically representing an operation of the acoustic instrument. A graphic synthesizer composes the model image and the dynamic image with each other so as to dynamically model the operation of the acoustic instrument in synchronization to the generation of the music sound.

18 Claims, 12 Drawing Sheets

MUSIC AND GRAPHIC APPARATUS AUDIO-VISUALLY MODELING ACOUSTIC INSTRUMENT

BACKGROUND OF THE INVENTION

The present invention relates to a parameter display apparatus for displaying, in an easy-to-understand manner, parameters supplied to a music sound synthesis module. More concretely, the present invention relates to a music and graphic apparatus for audio-visually modeling an acoustic instrument simulated by a music sound synthesis module or a sound source.

The music sound synthesis module or sound source is used in an electronic musical instrument for generating and outputting a music sound signal based on various parameters supplied to the sound source. To support the operation of the sound source, visual monitors are provided for checking the type and size of parameters to be supplied to the music sound synthesis module. These monitors include a parameter editor having an image display, a MIDI signal monitor, an oscilloscope, and a level meter.

The parameter editor having the image display provides a capability of displaying numeric values and graphs of the parameter. However, this parameter editor cannot display, in an easy-to-see manner, the relationship of a particular parameter with the generating algorithm of a music sound signal and a timbre change. The MIDI monitor provides nothing but a capability of simply displaying MIDI signals, so that it is useful only in checking for the MIDI signals. The oscilloscope and the level meter are devices for checking waveforms and levels of a generated music sound signal, and are therefore not useful in checking inputted parameters.

A physical model sound source simulates a vibration that is generated in a vibrating body or a resonating body of an acoustic instrument. The physical mode sound source has inevitable difficulties in sounding a music performance inherent to a musical acoustic instrument to be modeled. For example, it is difficult for beginners to operate with stability a typical acoustic musical instrument such as saxophone and trumpet. It is also difficult for beginners to operate a physical model sound source that simulates these acoustic musical instruments. To assist beginners in learning to play these acoustic musical instruments, it is desired to provide a capability of allowing beginners to visually check the relationship between the parameters to be used in performance operation and the music sounds to be voiced.

SUMMARY OF THE INVENTION

It is therefore an object of the present invention to provide a parameter display apparatus for displaying parameters supplied to a sound source in an easy-to-understand manner by arranging the parameters in association with performance or operation of the sound source, and to provide a music sound synthesis apparatus for audio-visually modeling an acoustic instrument simulated by the music sound synthesis module or sound source.

According to one aspect of the invention, a parameter display apparatus is constructed for displaying operation of a musical instrument according to a timbre parameter and a performance parameter. In the parameter display apparatus, a basic image generating means is provided for generating a basic image representing at least a part of a musical instrument which can produce a music sound having a timbre specified by the timbre parameter in response to the performance parameter. A performance image generating means is provided for generating a performance image representing an operation state of the musical instrument according to the performance parameter. An image synthesis means is provided for displaying the performance image in association with the basic image to thereby visually indicate the operation state of the musical instrument during the course of production of the music sound.

Preferably, the performance image generating means generates a finger performance image representing a fingering operation state of the musical instrument according to the performance parameter indicative of a pitch of the music sound produced by the musical instrument.

Preferably, the basic image generating means generates the basic image representing a mouthpiece part of a musical wind instrument. The performance image generating means generates a performance image representing a blowing operation state of the musical wind instrument in association with the mouthpiece part. Otherwise, the performance image generating means generates a performance image representing an air flowing operation state inside a pipe of the musical wind instrument in association with the mouthpiece part.

According to another aspect of the invention, a parameter display apparatus comprises means for displaying an operation image of a physical model sound source which simulates a vibrating or resonating body, means for providing a performance parameter to the physical model sound source so as to enable the vibrating or resonating body to generate a music sound, and means for graphically presenting a magnitude of the performance parameter in association with the displayed operation image of the physical model sound source.

According to a further aspect of the invention, a music sound synthesis apparatus is constructed for generating a music sound in response to a performance parameter. In the music sound synthesis apparatus, a physical model sound source is provided for simulating an acoustic musical instrument having a vibrating or resonating body. The physical model sound source is operative according to a performance parameter determining an operation state of the acoustic musical instrument so that a musical sound is generated as if voiced by exciting the vibrating or resonating body. A basic image generating means is provided for generating a basic image representing at least a part of the acoustic musical instrument. A performance image generating means is provided for generating a performance image representing the operation state of the acoustic musical instrument according to the performance parameter. An image synthesis means is provided for displaying the performance image in association with the basic image to thereby visually indicate the operation state of the acoustic musical instrument during the course of generation of the music sound.

In the present invention, when a parameter for indicating a pitch of performance is inputted for example, a performance image representing the fingering operation to control the pitch is displayed in superimposed relation to a manipulation part (a key system for a wind instrument and a finger board for a stringed instrument) of a basic image representing a musical instrument. This provides easy-to-understand display to teach the pitch currently being played and to teach the fingering operation required for playing this pitch. In addition, in the present invention, based on information inputted for the music performance, blowing parameters such as breath pressure and embouchure to be supplied to the music sound synthesis are represented in images, and an air flow inside a pipe of the instrument is represented by an image in association with an image of the mouthpiece. This provides easy-to-understand display of the current operation state during the music sound synthesis (for example, the excited state of the resonator). This in turn provides easy-to-understand display of the current operation state of how a music sound is synthesized or which parameter is to be supplied to the music sound synthesis module to synthesize the current music sound.

DETAILED DESCRIPTION OF EMBODIMENTS

Figure 1:
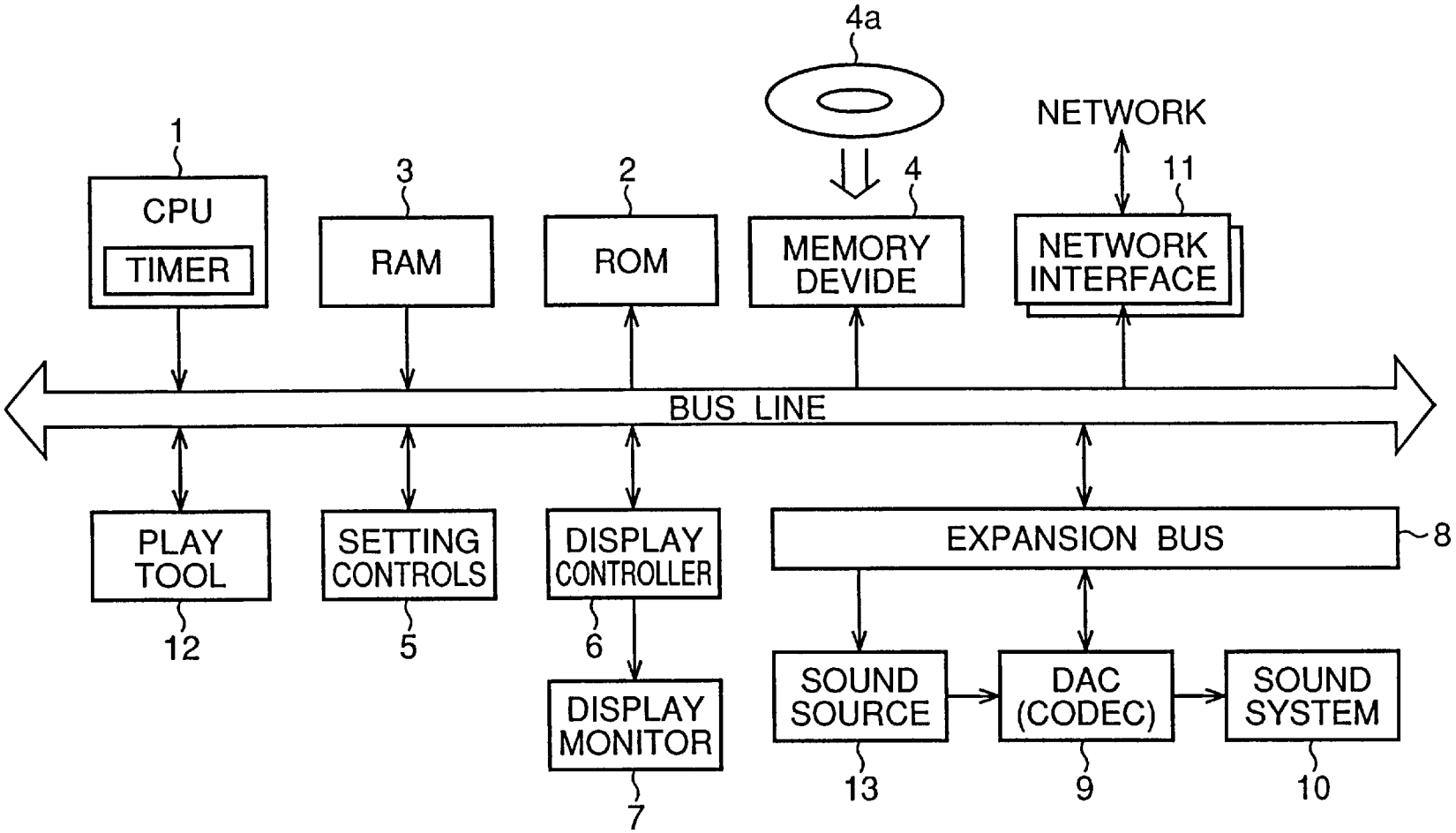
FIG. 1 is a block diagram illustrating a computer apparatus practiced as one preferred embodiment of the invention.

Now, referring to FIG. 1, there is shown a block diagram illustrating a constitution of a computer apparatus having a music sound synthesis capability practiced as one preferred embodiment of the invention. The computer apparatus is configured to work as a music and graphic apparatus for audio-visually modeling an acoustic instrument simulated by a music sound synthesis module or a sound source. This computer apparatus is applicable to not only a general-purpose personal computer but also various amusement equipment including a game machine and a karaoke apparatus and household appliances such as a television receiver. In this computer apparatus, a CPU 1 synthesizes a music sound waveform by use of an idle time in program processing. Programs to be executed by the CPU 1 include an automatic performance program for automatically performing a song, a program for graphically representing a parameter provided for synthesizing a music sound waveform at automatic performance, a network data browsing program, a word-processing program, and other application programs.

The CPU 1 executes an operating system (OS) and application programs. At the same time, the CPU 1 executes a music sound synthesis operation by means of a software sound source, one of the capabilities incorporated in the OS. The CPU 1 is connected through a bus to a ROM 2, a RAM 3, a memory device 4, setting controls 5, a display controller 6, and an expansion bus 8. The ROM 2 stores a basic program for starting this computer apparatus. The RAM 3 is loaded with the above-mentioned OS, an application program, and automatic performance data. The memory device 4 is used for treating a machine readable memory medium 4*a*, and is selected from a floppy disk drive, a hard disk drive, a CD-ROM drive, or a magneto-optical disk drive. The memory medium 4*a* stores the above-mentioned programs and automatic performance data and setting data for music sound waveform synthesis. The setting controls 5 include a keyboard, a mouse and a joystick, interconnected to the CPU 1 through an interface. The user operates these controls to start and stop application programs (for example, to start and stop automatic performance), and to select screen display modes. The display controller 6 includes a VRAM and a display interface to expand image data inputted from the CPU 1 into the VRAM, and displays the image data on a display monitor 7 such as a CRT. The expansion bus 8 is connected to a D/A converter (DAC) 9 for converting synthesized music sound waveform data into an analog music sound signal. The D/A converter 9 is connected to a sound system 10 for amplifying the analog signal and outputs the amplified analog signal.

Figure 2:
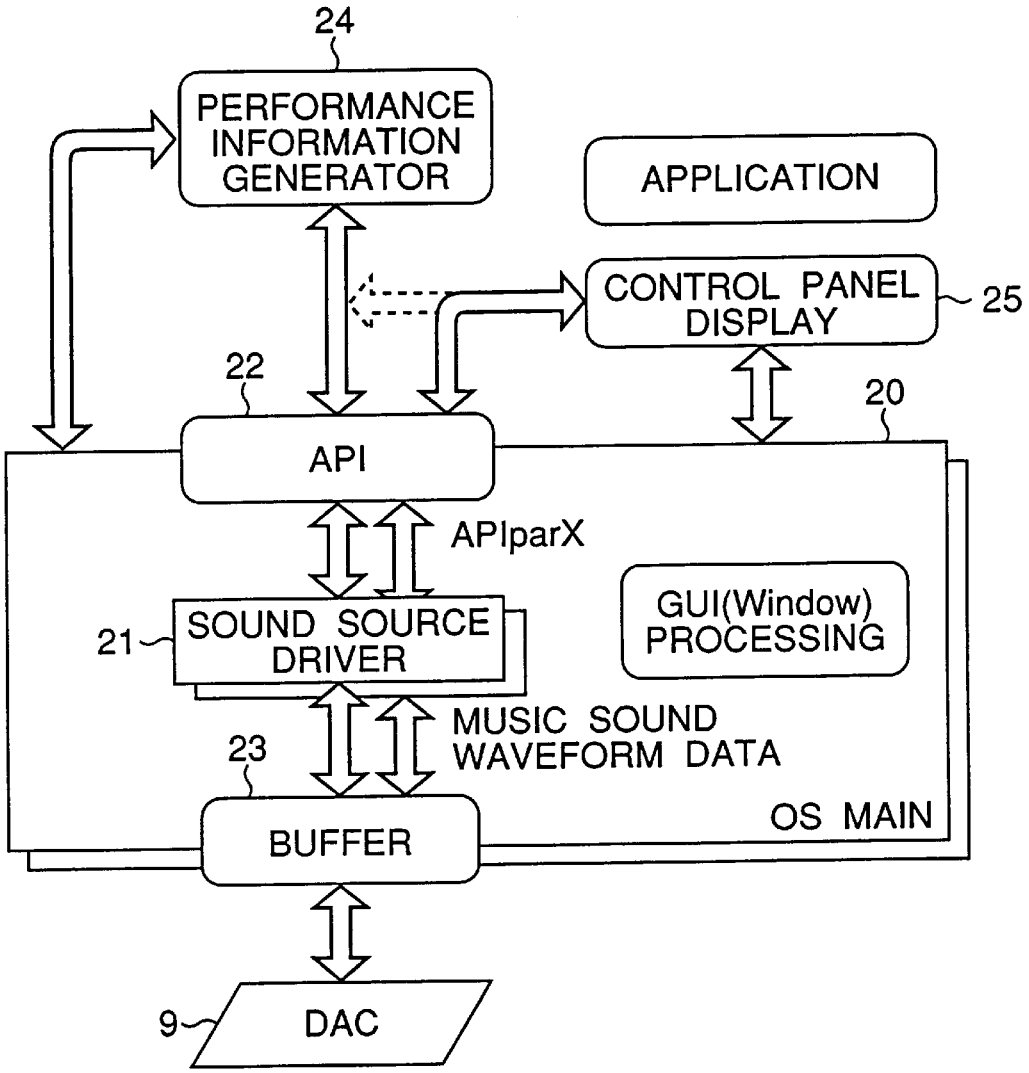
FIG. 2 is a diagram illustrating a relationship among programs to be executed by the above-mentioned computer apparatus.
Figure 3:
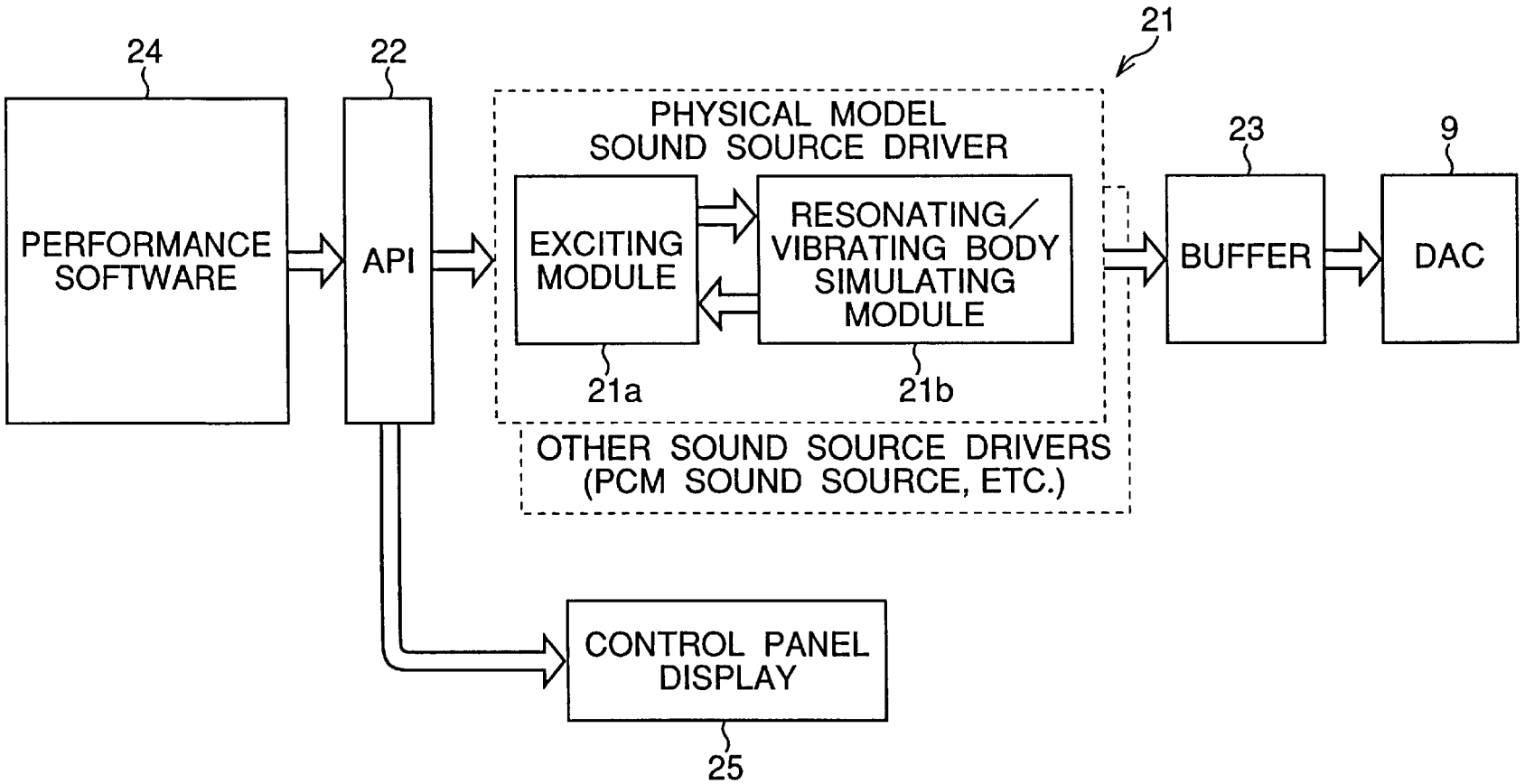
FIG. 3 is a diagram illustrating flows of data among modules implemented by the computer programs.

FIG. 2 shows a relationship among various programs to be executed by the CPU 1. FIG. 3 shows data flows among various modules implemented by the programs. The CPU 1 controls various application programs through the OS. For the application programs to be controlled, this figure shows a performance information generating program 24 for providing performance information to the automatic performance program and a graphic control panel program 25 for displaying parameters used for synthesizing a music sound waveform. A sound source driver 21 is incorporated in the OS domain. When an application program such as the performance information generating program 24 requests the OS for music sound generation, the OS starts the sound source driver 21 to generate a requested music sound waveform. The data transfer between this application program and the OS is handled through an API (Application Program Interface) 22. It should be noted that, in the present embodiment, the sound source driver 21 is a so-called software sound source for synthesizing music sound waveforms by means of the data processing capability of the CPU 1. The music sound waveforms are synthesized by use of a physical model sound source or a PCM sound source, for example. The physical model sound source simulates the principle of operation of an acoustic musical instrument that causes air vibration by exciting a vibrating or resonating body. The PCM sound source synthesizes a music sound waveform by provisionally sampling and recording music sounds of various acoustic musical instruments as PCM data, and by reading and manipulating this PCM data based on a pitch specified by the performance information. It should be noted that, in the present embodiment, the sound source driver 21 has both the physical model sound source to create a melody and the PCM sound source to create an accompaniment. The music sound waveform data synthesized by the sound source driver 21 is accumulated in a buffer 23. The above-mentioned D/A converter 9 reads the music sound waveform data from the buffer 23 in synchronization with a clock signal, and converts the read data into an analog music sound signal. The buffer 23 has a capacity of storing a maximum of 400 ms period of music sound waveform data, for example. The D/A converter 9 is adapted to read from the buffer 23 the performance information containing various parameters, 400 ms after the performance information has been inputted from the performance information generating program 24 through the API 22. The CPU 1 synthesizes a music sound waveform in an idle time by a task control. Namely, the CPU 1 synthesizes a music sound waveform by use of a time produced by this buffering effect of 400 ms. If there is any other task to be executed, the buffer can hold a maximum of 400 ms frame of music sound waveform.

On the other hand, the control panel display program 25 captures the aperformance information inputted from the performance information generating program 24 into the API 22, then translates the captured information into a graphic representative of a performance image of the sound source, and displays this graphic on the display monitor 7. This graphic operation is controlled by the OS main 20.

It should be noted that, as shown in FIG. 3, the sound source driver 21 of the physical model sound source consists of an exciting module 21*a* and a simulating module 21*b* of a resonating/vibrating body. A timbre parameter for determining a timbre of a music sound to be synthesized is set to the simulating module 21*b* of the resonating/vibrating body of a virtual acoustic instrument. The timbre is specific to a contour of the musical acoustic instrument to be simulated by the sound source. A performance parameter is set to the exciting module 21*a* of the physical model sound source to excite and sustain a vibration in order to generate the music sound.

In case that the physical model sound source is configured to simulate a wind instrument, the parameters to be inputted from the performance information generating program 24 into the API 22 include a timbre parameter, a pitch parameter, a blowing breath pressure parameter, an embouchure parameter, and an in-pipe turbulence setting parameter. In the case of a stringed instrument, the API 22 receives a timbre parameter, a pitch parameter, a bow position parameter for indicating a bow position relative to a string, a bowing speed parameter, and a bow pressure parameter.

According to the invention, as shown in FIGS. 2 and 3, the music and graphic apparatus or parameter display apparatus is implemented by the computer apparatus for displaying operation of a musical instrument according to a timbre parameter and a performance parameter. In the parameter display apparatus, a basic image generating means is implemented by the control panel display program 25 for generating a basic image representing at least a part of a musical instrument which can produce a music sound having a timbre specified by the timbre parameter in response to the performance parameter. A performance image generating means is also implemented by the control panel display program 25 for generating a performance image representing an operation state of the musical instrument according to the performance parameter. An image synthesis means is further implemented by the control panel display program 25 for displaying the performance image in association with the basic image to thereby visually indicate the operation state of the musical instrument during the course of production of the music sound.

For instance, the performance image generating means may generate a finger performance image representing a fingering operation state of the musical instrument according to the performance parameter indicative of a pitch of the music sound produced by the musical instrument. Further, the basic image generating means generates the basic image representing a mouthpiece part of a musical wind instrument. The performance image generating means generates a performance image representing a blowing operation state of the musical wind instrument in association with the mouthpiece part. Otherwise, the performance image generating means generates a performance image representing an air flowing operation state inside a pipe of the musical wind instrument in association with the mouthpiece part.

According to the invention, the computer apparatus or the parameter display apparatus is comprised of a software module implemented by the control panel display program 25 for displaying an operation image of a physical model sound source 21 which simulates a vibrating or resonating body, and another software module implemented by the automatic a performance program 24 for providing a performance parameter to the physical model sound source so as to enable the vibrating or resonating body to generate a music sound. In such a case, the software module implemented by the control panel display program 25 graphically presents a magnitude of the performance parameter in association with the displayed operation image of the physical model sound source.

According to the invention, the music sound synthesis apparatus is configured by the computer apparatus for generating a music sound in response to a performance parameter. In the music sound synthesis apparatus, the physical model sound source 21 is provided for simulating an acoustic musical instrument having the vibrating or resonating body. The physical model sound source 21 is operative according to a performance parameter determining an operation state of the acoustic musical instrument so that a musical sound is generated as if voiced by exciting the vibrating or resonating body. A basic image generating means is provided by means of the control panel display program 25 for generating a basic image representing at least a part of the acoustic musical instrument. A performance image generating means is provided also by means of the control panel display program 25 for generating a performance image representing the operation state of the acoustic musical instrument according to the performance parameter. An image synthesis means is further provided by means of the control panel display program 25 for displaying the performance image in association with the basic image to thereby visually indicate the operation state of the acoustic musical instrument during the course of generation of the music sound.

Figure 4:
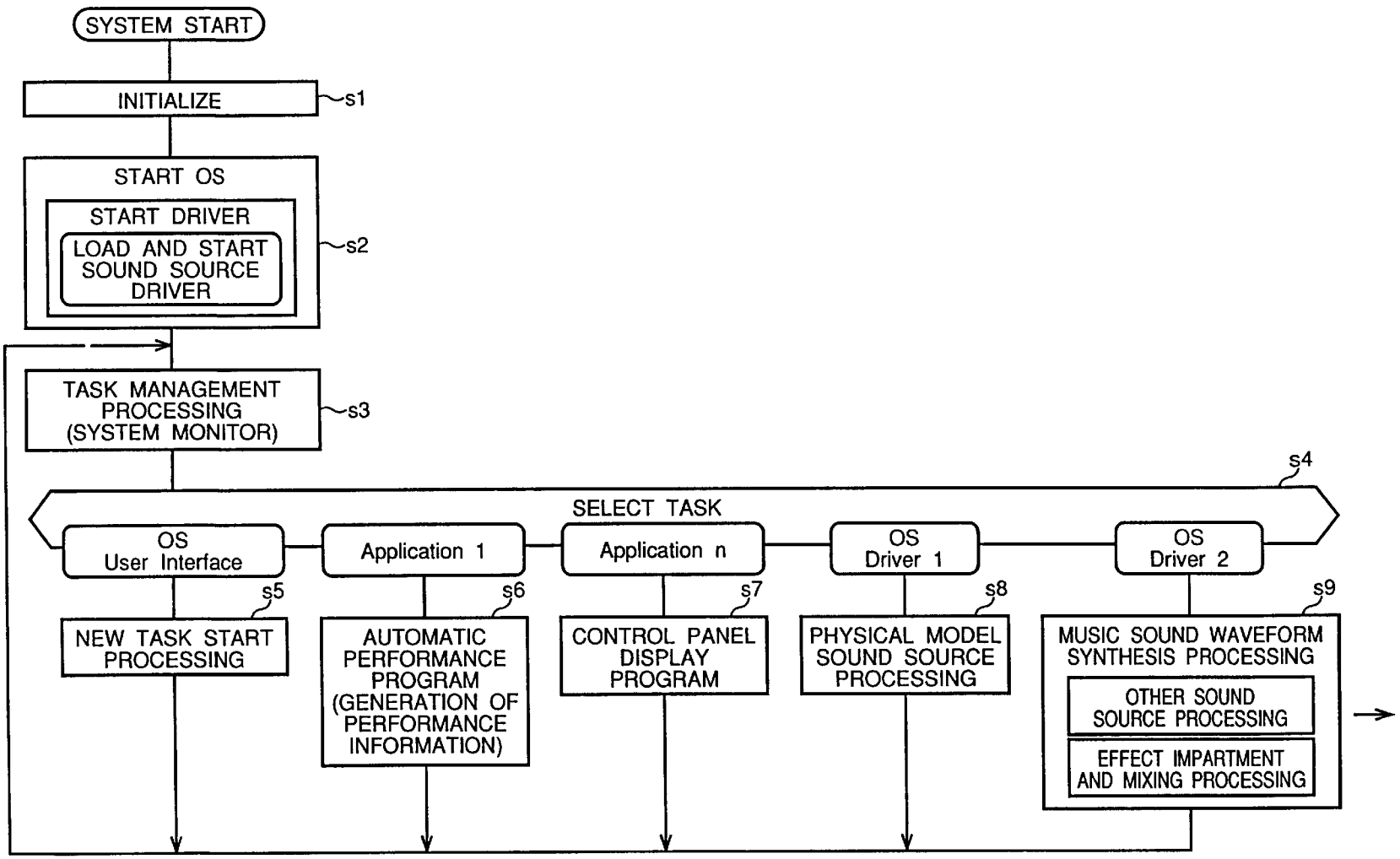
FIG. 4 is a flowchart indicative of operations of the above-mentioned computer apparatus.
Figure 5:
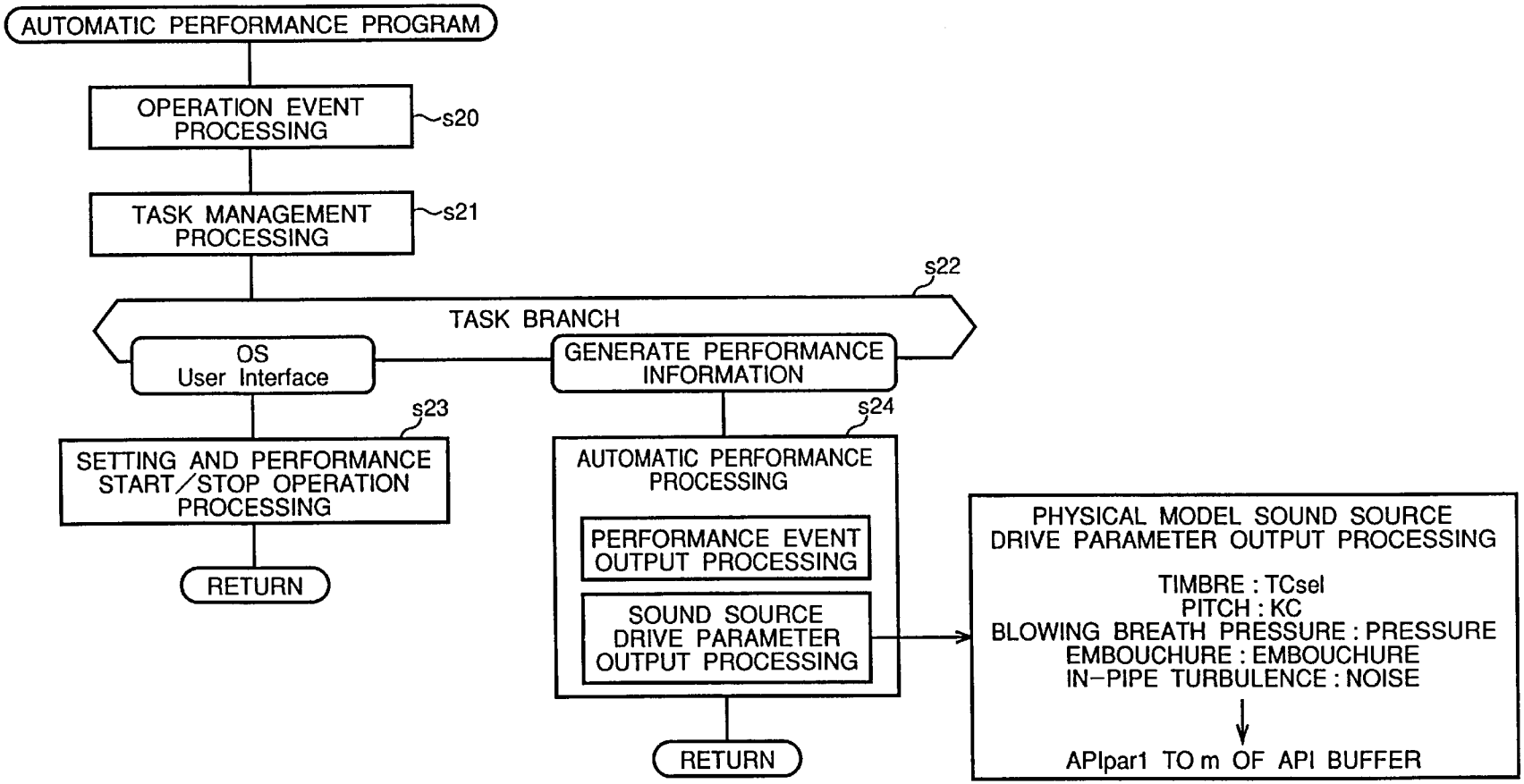
FIG. 5 is a flowchart indicative of other operations of the above-mentioned computer apparatus.
Figure 6:
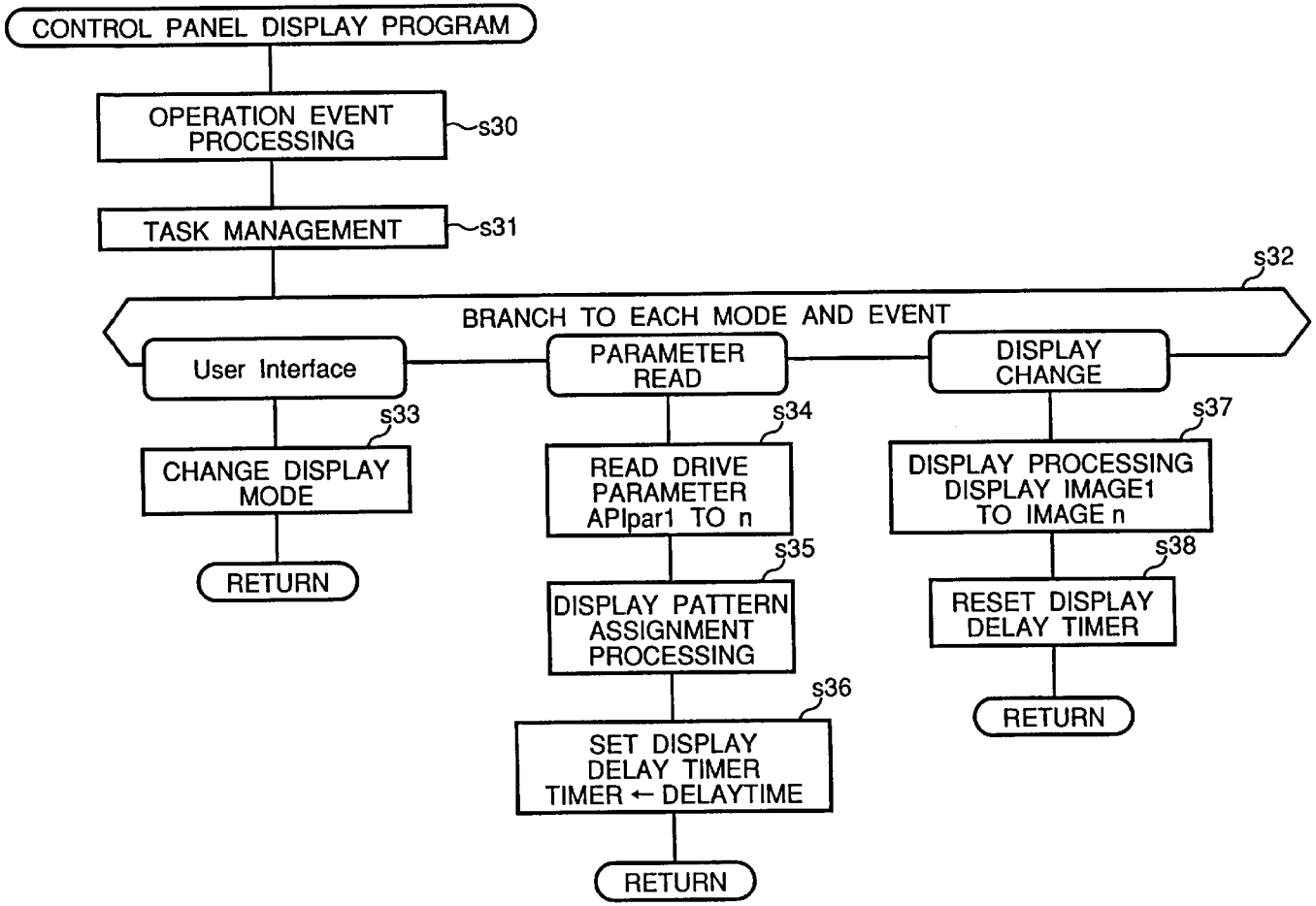
FIG. 6 is a flowchart indicative of still other operations of the above-mentioned computer apparatus.

FIGS. 4 through 6 are flowcharts indicative of operations of the above-mentioned computer apparatus. FIG. 4 is a flowchart indicative of the main processing operation. When the computer apparatus is powered on and the system gets started, initialization processing is executed (step s1). This initialization processing is executed by an initializing program stored in the ROM 2. Next, the OS and programs stored in the memory device 4 such as a hard disk drive are loaded into the RAM 3 to start the music and graphic apparatus (step s2). This OS boot processing includes load processing of various drivers incorporated in the OS. As a part of this processing, loading of the above-mentioned sound source driver 21 is included. When the OS has been started, each task becomes ready for data acceptance and execution. In step s3, a task request from the user or an application program is received, and task management processing is called for determining which task is to be executed based on predetermined priority. Then, a selected task is determined (step s4) and this task is executed. This flowchart shows various tasks denoted by steps s5 through s9. In step s5, processing for starting a new task is executed according to a user operation or a machine operation. In step s6, the automatic performance program is executed to generate the performance information. In step s7, the control panel display program is executed. In step s8, processing of the physical model sound source or the melody sound source is executed. In step s9, musical sound waveform synthesis is executed. Various other tasks are executed according to situations. The task management processing of step s3 determines their execution sequence.

The physical model sound source processing of step s8 synthesizes a music sound waveform based on the various performance parameters including a timbre parameter, a pitch parameter, a blowing breath pressure parameter, an embouchure parameter, and an in-pipe turbulence setting parameter, which are retrieved from the API 22 while the automatic performance program is being executed. In step s9, music sound waveform synthesis processing of other sound sources is executed. This processing includes an operation for executing, in software approach, the PCM sound source for accompaniment generation, and an operation for imparting an appropriate effect to the music sound waveforms formed by the above-mentioned physical model sound source and by the PCM sound source and for distributing the resultant waveforms in two stereo channels.

The following describes in detail the operation of the above-mentioned automatic performance program (step 6) with reference to the flowchart shown in FIG. 5. First, in step s20, an operation event is detected. The operation event is an input operation such as selection of a song, start or stop of performance, or setting of tempo, timbre, or volume through the setting controls 5. The operation event is inputted in the CPU 1 through the interface. The task management processing (step s21) determines which of the above-mentioned processing operations such as the operation event processing and the performance information generating processing is to be executed. The task selected by the task management processing is called in step s22 to be executed. The tasks to be executed include the setting and performance start/stop operation processing (step s23) and the automatic performance processing (step s24). The setting and performance start/stop operation processing changes automatic performance setting according to the operation event, starts the automatic performance, and stops the automatic performance when an object song ends. The performance information generating operation (step s24) includes processing for sequentially reading automatic performance data to output performance events of accompaniment, and processing for outputting a parameter for controlling the physical model sound source. The performance information generating operation generates a timbre parameter TCsel, a pitch parameter KC, a blowing breath pressure parameter PRESSURE, an embouchure parameter EMBOUCHURE, and an in-pipe turbulence parameter NOISE from the automatic performance data for driving the physical model sound source, and writes these parameters into parameter buffers APIpar1 through APIpar5 of the API 22. Namely, the timbre parameter TCsel is assigned to the APIpar1, the pitch parameter KC is assigned to the APIpar2, the blowing breath pressure parameter PRESSURE is assigned to the APIpar3, the embouchure parameter EMBOUCHURE is assigned to the APIpart4, and the in-pipe turbulence parameter NOISE is assigned to the APIpar5.

Figure 7:
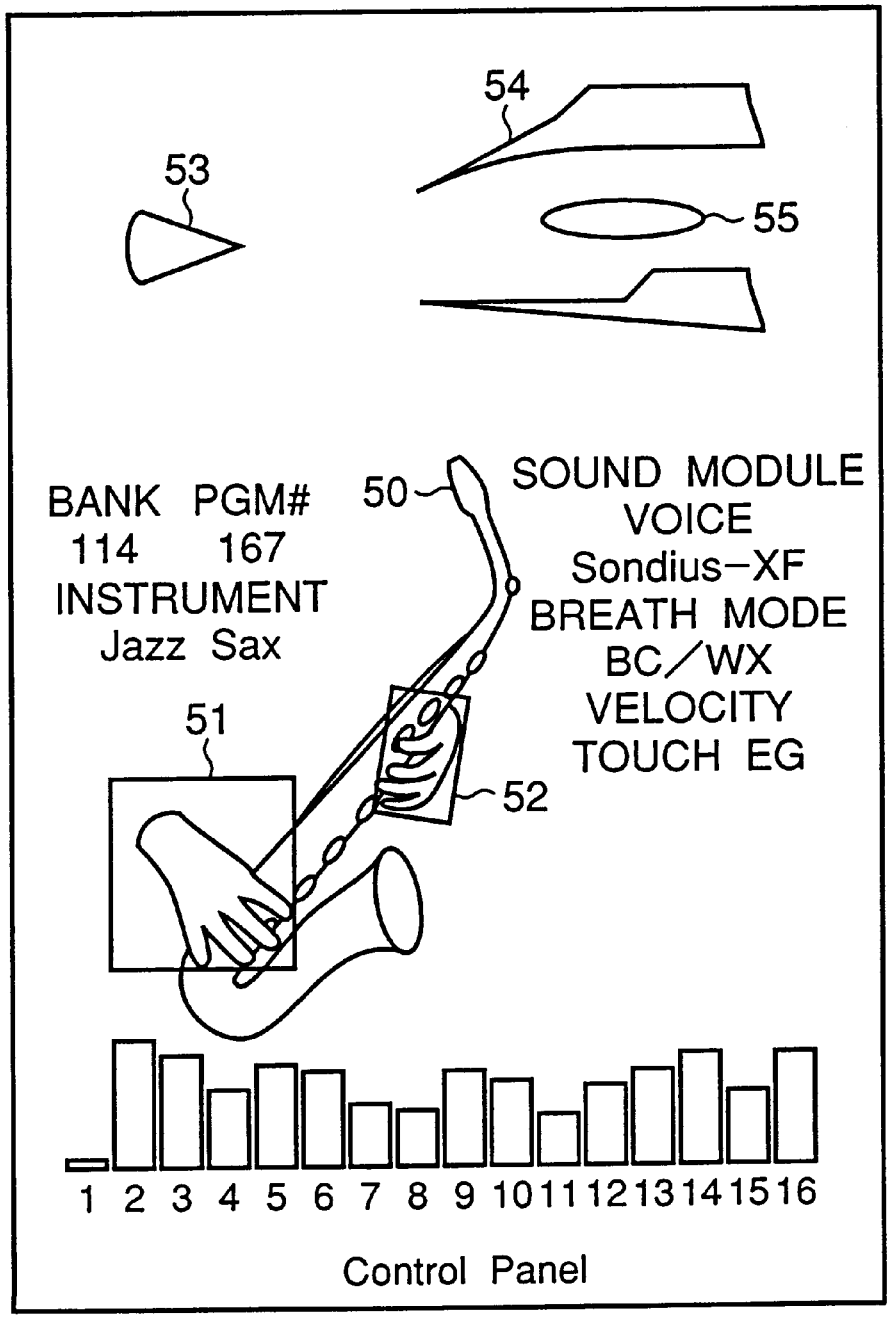
FIG. 7 is a diagram illustrating a display example on a monitor of the above-mentioned computer apparatus.
Figure 8:
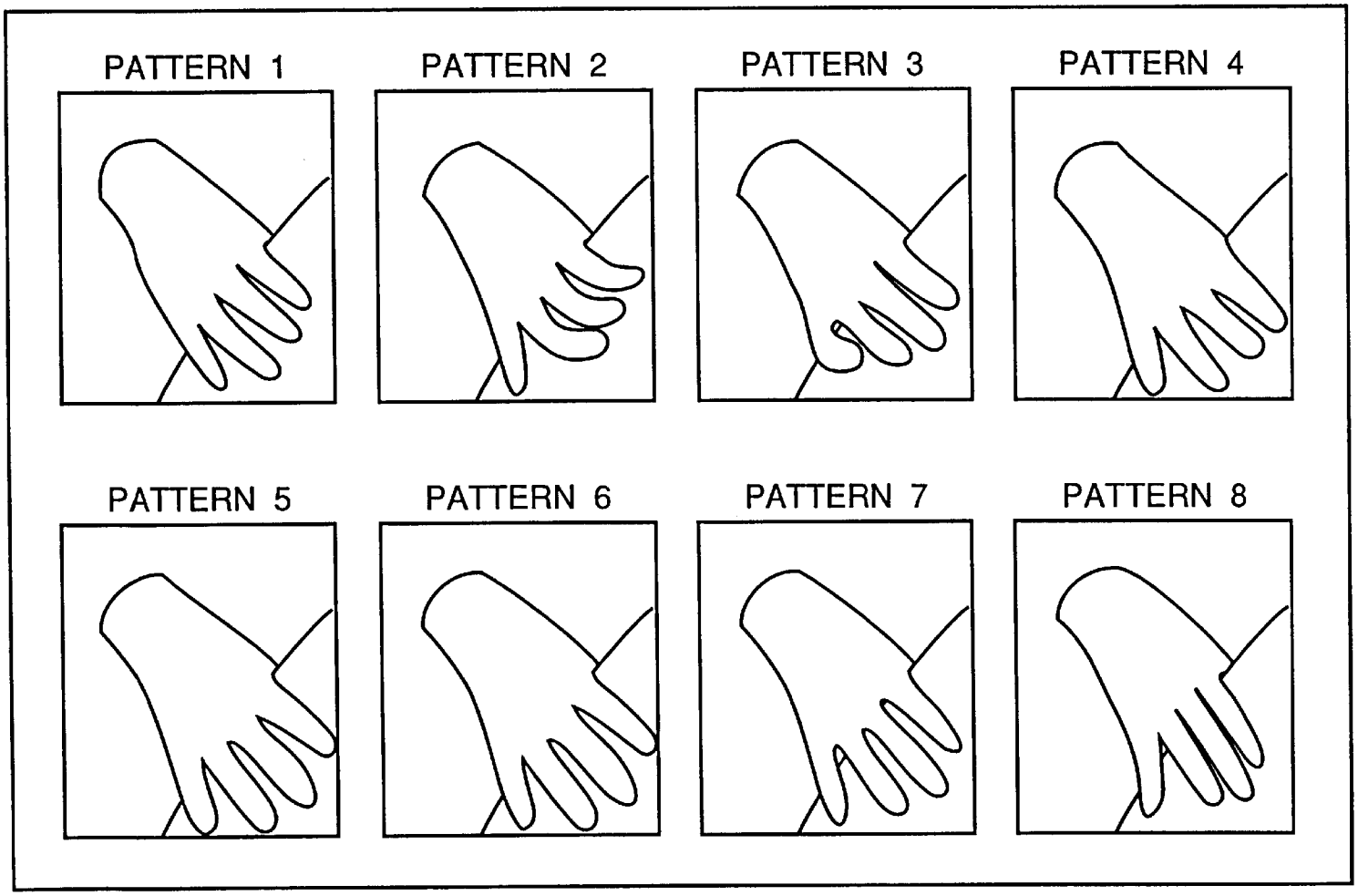
FIG. 8 is a diagram illustrating a pattern table showing right-hand fingering images to be displayed on the monitor.
Figure 9:
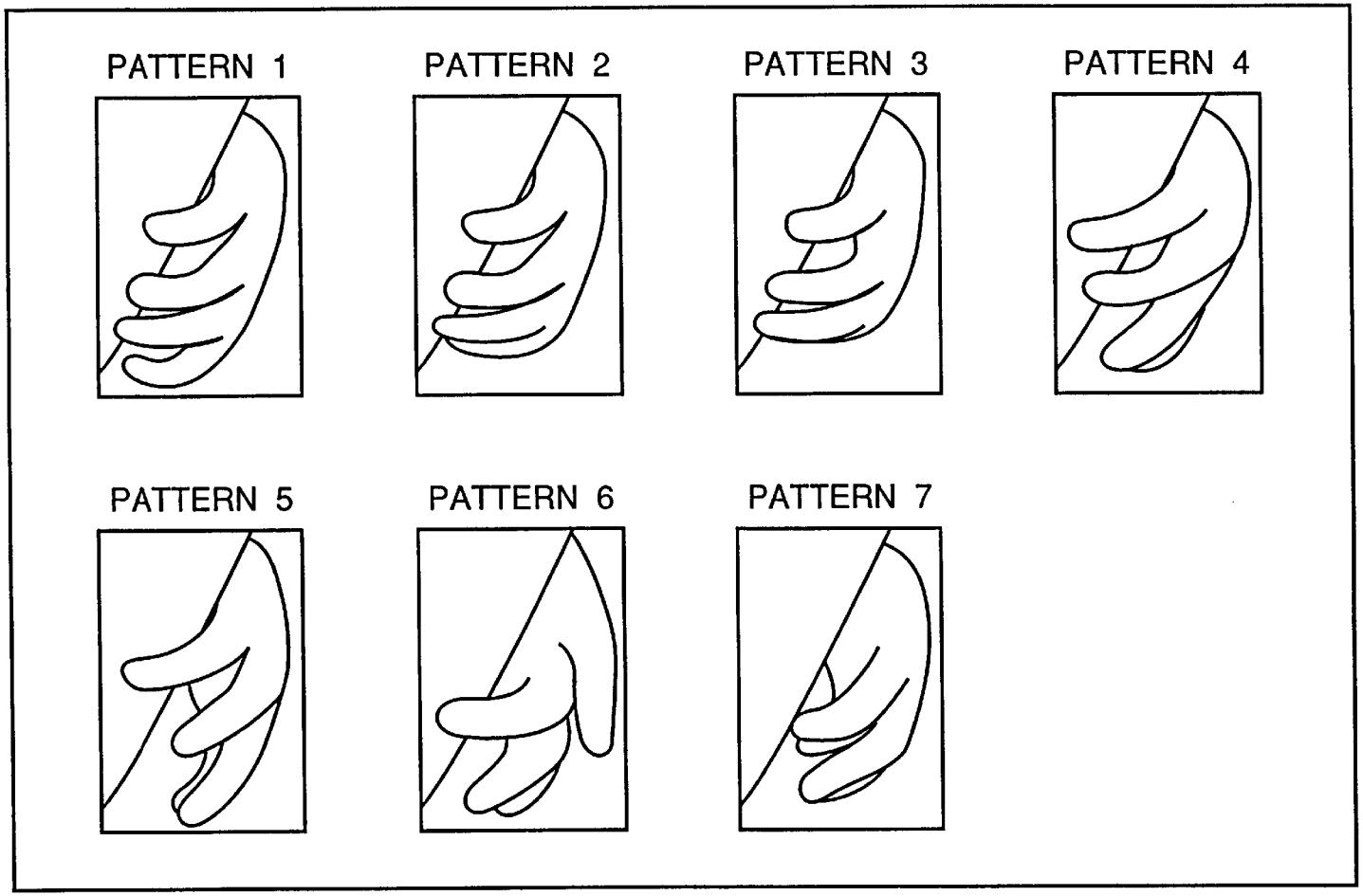
FIG. 9 is a diagram illustrating a pattern table showing left-hand fingering images to be displayed on the monitor.
Figure 10:
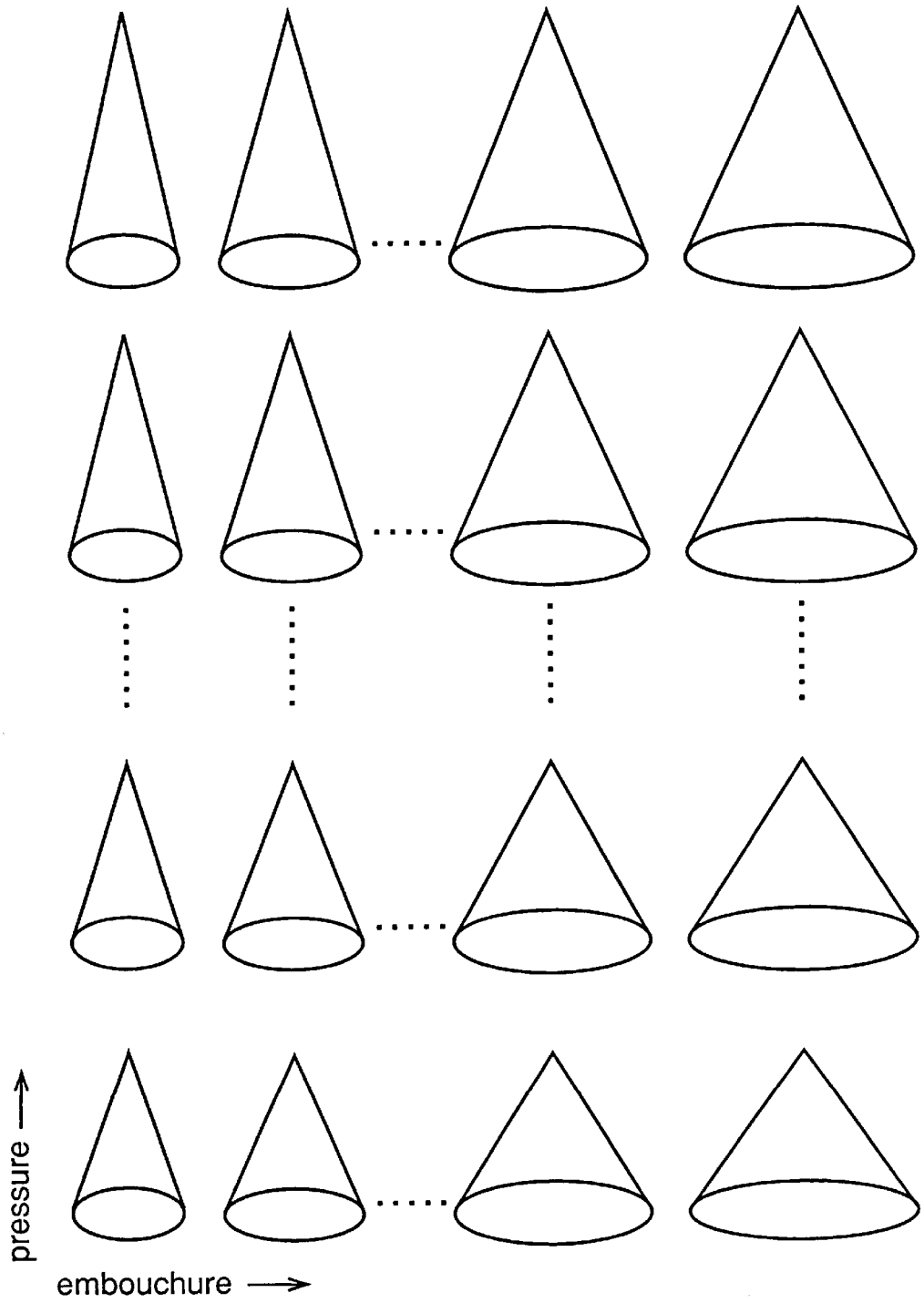
FIG. 10 is a diagram illustrating a display example of embouchure and breath pressure on the monitor.

The following describes in details the control panel display program with reference to the flowchart shown in FIG. 6, a display example shown in FIG. 7 and an example of operation image data shown in FIGS. 8 through 10. First, a user operation event is detected (step s30). The user can input a change of a display form such as display size and color for this control panel display program. Then, the task management processing is executed (step s31). Subsequently, which of plural tasks is to be executed is determined by the task management processing (step s31). The task selected by this task management processing is called in step s32 to be executed. Tasks to be executed include display form change processing (step s33), parameter read processing (steps s34 through s36), and display change processing (steps s37 and s38).

In this control panel display program, a screen such as shown in FIG. 7 is displayed on the display monitor 7. The center of the screen displays a timbre number, a timbre name, and an instrument corresponding to this timbre. These graphic contents are selected by the timbre parameter APIpar1 (TCsel) read from the API 22. In this figure, the currently selected timbre is "Jazz Sax," which is identified by timbre number 114 in terms of bank number of the physical model sound source or timbre number 167 in terms of control change number of MIDI. For the instrument, an image of alto sax and images of right and left hands of a player are displayed. This picture is obtained by attaching a right-hand image 51 and a left-hand image 52 to a basic image 50. The right-hand image 51 and the left-hand image 52 change in their finger movements according to the pitch specified by the erformance information. The basic image 50 is selected by the timbre parameter APIpar1 (TCsel). This picture may be displayed in animation based on additional information; for example, the instrument is swung every time a note-on event occurs and moved up and down according to a volume of the music sound.

FIGS. 8 and 9 show a right-hand pattern table and a left-hand pattern table, respectively. As shown in FIG. 8, the right-hand pattern table lists eight partial images showing different fingerings. The left-hand pattern table lists seven partial images showing different fingerings as shown in FIG. 9. In an acoustic musical instrument, music sounds having various pitches can be created by combinations of these right-hand and left-hand fingerings. This control panel display program determines an image of the fingerings corresponding to a music sound having a pitch specified by the pitch parameter APIpar2 (KC) provided from the API. The images of right-hand and left-hand fingerings may be stored in the combination table of each pitch.

In the upper left portion of the screen shown in FIG. 7, a conical image 53 is depicted to indicate the operation state of the acoustic instrument. This conical image 53 has a variable size and shape for representing a magnitude of the blowing breath pressure parameter APIpar3 (PRESSURE) and the embouchure parameter APIpar4 (EMBOUCHURE) read from the API. The height of the cone (the dimension along the length of the cone) corresponds to the blowing breath pressure parameter APIpar3 (PRESSURE) and the diameter of the bottom (the dimension across the length of the cone) corresponds to the embouchure parameter APIpar4 (EMBOUCHURE).

FIG. 10 shows a constitution of an image table indicative of this conical image 53. This image table lists 64 number of conical images having different combination of 8 heights and 8 bottom diameters. Each of the blowing breath parameter APIpar3 (PRESSURE) and the embouchure parameter APIpar4 (EMBOUCHURE) takes values 0 to 127. Values 1 to 127 except for 0 are divided into 8 levels, and are assigned to this image table. This division may be made equally, or lower values may be divided finely while higher values coarsely.

The upper right portion of the screen shown in FIG. 7 depicts a cross section 54 of a mouthpiece part of a musical wind instrument corresponding to the timbre selected by the timbre parameter APIpar1 (TCsel). Below this cross section, an elliptic image 55 is depicted to indicate an in-pipe turbulence. The in-pipe turbulence is one of physical states inside the physical model sound source for determining a noise component of the music sound. The value of the in-pipe turbulence is determined by the in-pipe turbulence setting parameter APIpar5 (NOISE) and the blowing breath pressure parameter APIpar3 (PRESSURE). The elliptic image 55 changes in its height and width according to the values of the in-pipe turbulence setting parameter APIpar5 (NOISE) and the blowing breath pressure parameter APIpar3 (PRESSURE), thereby representing the magnitude of the in-pipe turbulence.

It should be noted that, in the bottom portion of the screen shown by FIG. 7, the levels of the MIDI channels are denoted graphically. In the center right portion of the screen shown by FIG. 7, various settings of the sound source are indicated.

Now, referring to the flowchart of FIG. 6 again, if the task of parameter read processing is selected, the parameters APIarp1 through APIpar5 are retrieved from the API 22 (step s34). Characters and images are selected for these read parameters (step s35). Then, in order to display the selected characters and images, a display delay timer of 400 ms is set (step s36). After the parameters are inputted in the sound source driver 21 and before a music sound corresponding the parameters is outputted by the D/A converter 9, there is a time lag of 400 ms period. The display delay timer provides a timing adjustment between the timing of music sound voicing and the timing of display switching.

The task management processing of step s31 monitors this timer. When this timer has reached a preset time, the task of the display change processing (steps s37 and s38) is selected. In step s37, each of the images selected in step s35 is read and inputted in the display controller 6. These images are displayed on the virtual control panel screen of the display monitor 7. Then, the display delay timer is reset (step s38).

In the above-mentioned graphic operation, the entire model image 50 of the musical instrument displayed based on the APIarp1 and the cross section 54 of the mouthpiece correspond to the basic image of the instrument, and the partial images 51 and 52 of fingering, the conical image 53 representing the blowing breath pressure and embouchure, and the image 55 representing the in-pipe turbulence correspond to the performance image or dynamic image of the instrument. This arrangement allows the performance parameters for controlling the operation of the physical model sound source to be graphically represented in synchronization with the sounding based on the performance parameters. Therefore, the user can easily know with which parameter a music sound is currently voiced.

Figure 11:
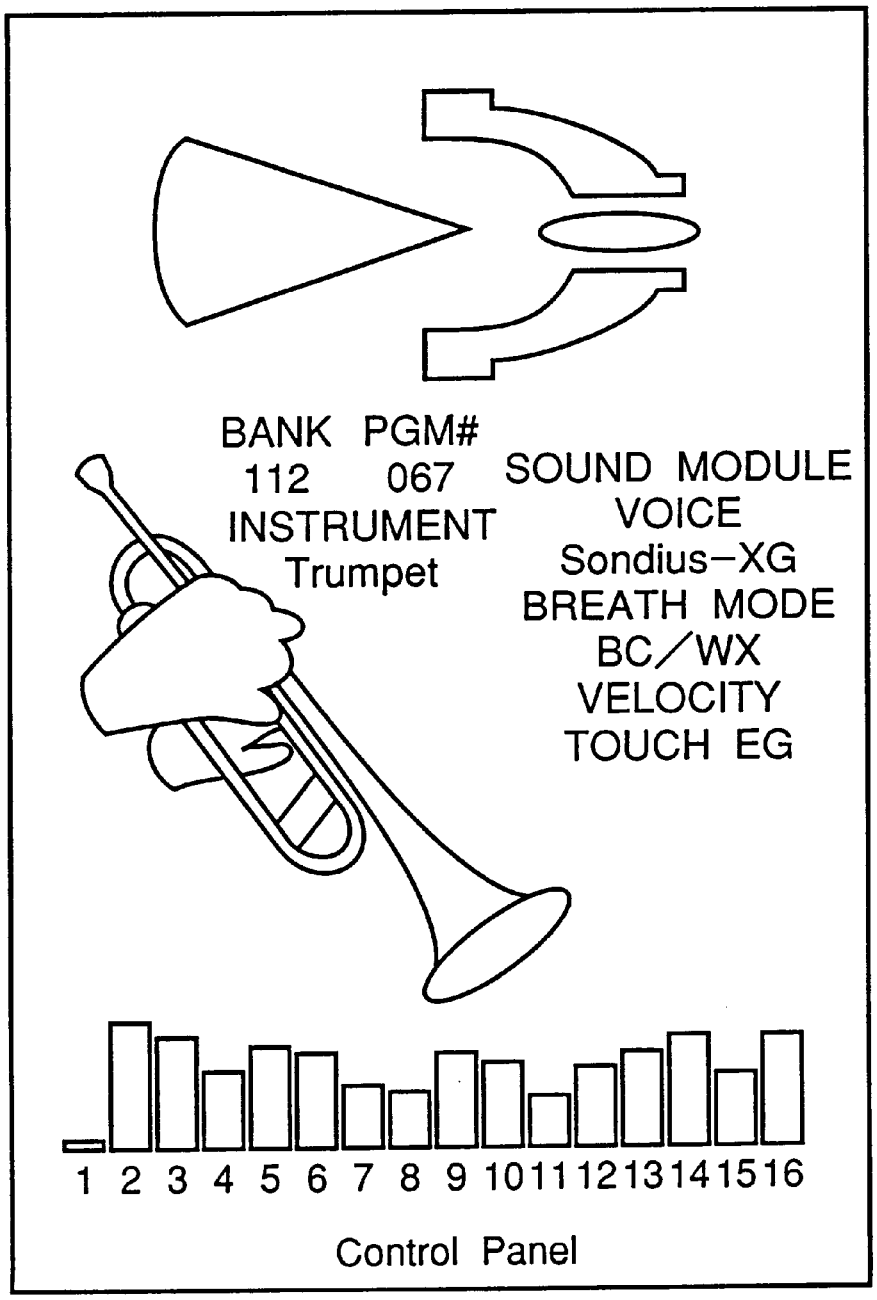
FIG. 11 is a diagram illustrating a display example of the monitor corresponding to a trumpet timbre.
Figure 12:
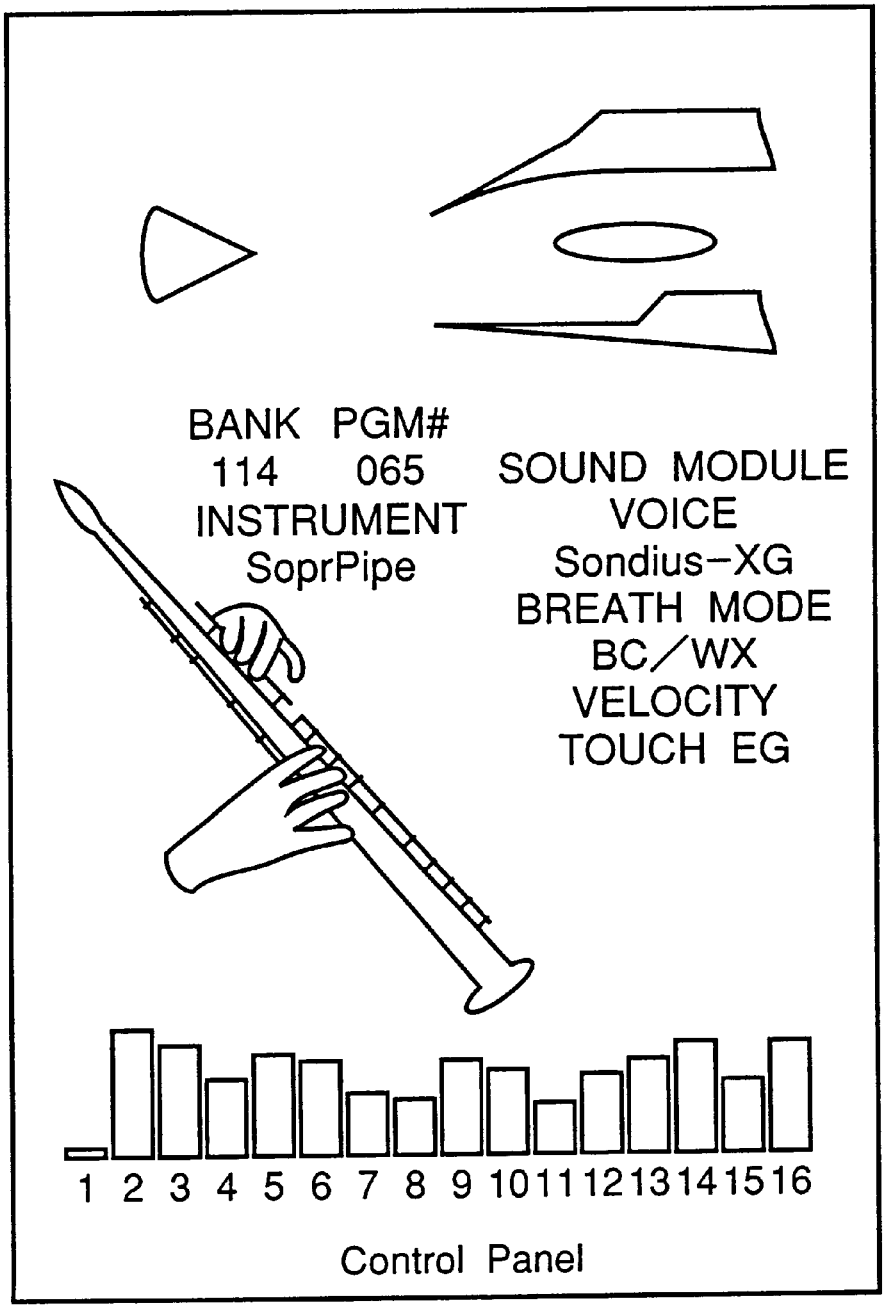
FIG. 12 is a diagram illustrating a display example of the monitor corresponding to a soprano sax timbre.

FIGS. 11 and 12 show examples of the control panel display for other acoustic instruments than that shown in FIG. 7. FIG. 11 shows a control panel modeling a trumpet, and FIG. 12 shows a control panel modeling a soprano sax.

In the above-mentioned embodiment, the right-hand partial images and the left-hand partial images are combined one by one according to the pitch specified by the performance information. Alternatively, plural partial images in which the right and the left hands are drawn together may be provided. One of the plural partial images is selected according to the pitch. Alternatively still, in sequentially switching the right-hand and left-hand partial images, a preceding display image and the following display image may be interpolated every predetermined time to smooth the image changing. Alternatively again, the image 54 of the wind instrument mouthpiece may be dynamically moved to open and close the tip of the mouthpiece in response to the embouchure parameter.

If the timbre of a stringed instrument such as violin is selected instead of a wind music instrument, partial images representing fingers pressing the string and representing a bow sliding on the string are composed with the basic image of violin. These partial images are dynamically switched in response to the performance information. For the physical model sound source, not only actually existing acoustic instruments such as sax, trumpet, and violin may be modeled, but also a virtual vibrating or resonating body or a virtual combination of a vibrating body and a resonating body (for example, resonating the violin string by the sax pipe) may be simulated. In this case, a basic image for representing this simulation and an image for representing performance mode are originally created for the graphic display.

The above-mentioned embodiment is associated with the computer apparatus having a so-called software sound source realized by synthesizing music sound waveforms by the CPU 1. Alternatively, a hardware sound source 13 may be provided outside the computer apparatus (refer to FIG. 1), in which the CPU 1 (the OS main) inputs parameters into this hardware sound source 13. In this case, the sound source driver 21 may provide a control program for the hardware sound source 13.

In the above-mentioned embodiment, the automatic performance is executed by reading the performance data stored beforehand. Alternatively, the play tool 12 may be connected to the computer apparatus (refer to FIG. 1) for live performance. In this case, the performance information generating program 24 shown in FIG. 2 is replaced by an input control program for the play tool 12 such as a keyboard. Alternatively still, the automatic performance and the live performance may be combined with each other.

Alternatively, a network interface 11 (refer to FIG. 1) may be provided, over which application programs, performance data, and so on are received.

As described above, in the inventive music and graphic apparatus, a performance input device in the form of the play tool 12 or else provides performance information effective to control generation of a music sound. A timbre input device in the form of the setting controls 5 or else provides timbre information effective to specify a timbre of the music sound. The hardware sound source 13 or the software sound source 21 is operative based on the timbre information to simulate an acoustic instrument capable of creating the specified timbre. The hardware sound source 13 or the software sound source 21 is responsive to the performance information to generate the music sound as if voiced by the acoustic instrument with the specified timbre. A model image generator is composed of the control panel display program 25 executed by the CPU 1 to generate a model image graphically representing at least a part of the acoustic instrument. A dynamic image generator is also composed of the control panel display program 25 executed by CPU 1. The dynamic image generator is operative according to the performance information for generating a dynamic image graphically representing an operation of the acoustic instrument. A graphic synthesizer is also composed of the control panel display program 25 executed by CPU 1. The graphic synthesizer composes the model image and the dynamic image with each other so as to dynamically model the operation of the acoustic instrument in synchronization to the generation of the music sound.

The performance input device sequentially provides performance information indicative of a manual operation of an acoustic instrument so as to control a pitch of the music sound. The dynamic image generator operates according to the performance information for generating a dynamic image graphically representing the manual operation of the acoustic instrument. The graphic synthesizer dynamically models the manual operation of the acoustic instrument so as to visually teach how the acoustic instrument should be manipulated to control the pitch of the music sound. Particularly, the performance input device sequentially provides performance information indicative of a manual operation for fingering an acoustic wind instrument. The dynamic image generator generates a dynamic image graphically representing the manual operation for fingering the acoustic wind instrument. The graphic synthesizer dynamically models the manual operation for fingering the acoustic wind instrument so as to visually teach how the acoustic instrument should be fingered to control the pitch of the music sound.

The performance input device sequentially provides performance information indicative of a physical operation of an acoustic instrument so as to control the music sound. The dynamic image generator operates according to the performance information for generating a dynamic image graphically representing the physical operation of the acoustic instrument. The graphic synthesizer dynamically models the physical operation of the acoustic instrument so as to visually teach how the acoustic instrument should be physically operated to control the music sound. Particularly, the performance input device sequentially provides performance information indicative of a physical blowing operation at a mouthpiece of an acoustic wind instrument so as to control the music sound. The dynamic image generator operates according to the performance information for generating a dynamic image graphically representing the physical blowing operation at the mouthpiece of the acoustic instrument. The graphic synthesizer dynamically models the physical blowing operation of the acoustic instrument so as to visually teach how the acoustic wind instrument should be physically blown at the mouthpiece to control the music sound. Further, the dynamic image generator operates according to the performance information for generating a dynamic image graphically representing the operation of the acoustic instrument such that a shape and a size of the dynamic image varies in association with a value of the performance information.

The invention covers the machine readable medium 4*a* for use in the computer apparatus having the CPU 1 and audio-visually modeling an acoustic instrument. The medium 4*a* contains program instructions executable by the CPU 1 for causing the computer apparatus to perform the method comprising the steps of providing performance information effective to control generation of a music sound, providing timbre information effective to specify a timbre of the music sound, configuring a sound source based on the timbre information to simulate an acoustic instrument capable of creating the specified timbre, driving the sound source in response to the performance information to generate the music sound as if voiced by the acoustic instrument with the specified timbre, generating a model image graphically representing at least a part of the acoustic instrument, generating a dynamic image graphically representing an operation of the acoustic instrument according to the performance information, and composing the model image and the dynamic image with each other so as to dynamically model the operation of the acoustic instrument in synchronization to the generation of the music sound.

As mentioned above and according to the invention, the current manual operation state and the current physical operation state can be visualized in an easy-to-understand manner by displaying the basic image representing a part or whole of a musical instrument and the performance image representing the operation state of the musical instrument. According to the present invention, an image for representing fingering according to a pitch parameter is displayed, thereby providing easy-to-understand display effective to teach a pitch of a music sound currently voiced and proper fingering to be employed to sound a current pitch. According to the present invention, an image representing a blowing operation is displayed in association with the basic image of the mouthpiece of a wind instrument, or an image representing an air flow inside the pipe of the wind instrument is displayed in association with the basic image of a mouthpiece of a wind instrument, thereby visually providing easy-to-understand display of parameters supplied for sounding a current pitch. According to the present invention, the physical model sound source simulates a vibrating body or a resonating body of an acoustic instrument to excite the same by a performance parameter obtained by simulating performance operation of the acoustic instrument. In the physical model sound source, a currently supplied parameter can be displayed in an easy-to-understand manner. In addition, what music sound is voiced by which parameter can be displayed in an easy-to-understand manner. Further, the physical model sound source allows the user to visually grasp the behavior of a model musical instrument in response to performance operation, thereby assisting the user in learning the performance of the physical model sound source that otherwise could hardly create appropriate parameters.

What is claimed is:

1. A parameter display apparatus for displaying operation of a musical instrument according to a timbre parameter and a performance parameter, comprising:

basic image generating means for generating a basic image representing at least a part of a musical instrument which can produce a music sound having a timbre specified by the timbre parameter in response to the performance parameter;

performance image generating means for generating a performance image representing an operation state of the musical instrument according to the performance parameter; and image synthesis means for displaying the performance image in association with the basic image to thereby visually indicate the operation state of the musical instrument during the course of production of the music sound.

2. The parameter display apparatus as claimed in claim 1, wherein the performance image generating means generates a finger performance image representing a fingering operation state of the musical instrument according to the performance parameter indicative of a pitch of the music sound produced by the musical instrument.

3. The parameter display apparatus as claimed in claim 1, wherein the basic image generating means generates the basic image representing a mouthpiece part of a musical wind instrument, and wherein the performance image generating means generates a performance image representing a blowing operation state of the musical wind instrument in association with the mouthpiece part.

4. The parameter display apparatus as claimed in claim 1, wherein the basic image generating means generates the basic image representing a mouthpiece part of a musical wind instrument, and wherein the performance image generating means generates a performance image representing an air flowing operation state inside a pipe of the musical wind instrument in association with the mouthpiece part.

5. A parameter display apparatus comprising:

a physical model sound source which simulates a vibrating or resonating body;

means for displaying an operation image of the physical model sound source;

means for providing a performance parameter to the physical model sound source so as to enable the vibrating or resonating body to generate a music sound; and means for graphically presenting a magnitude of the performance parameter in association with the displayed operation image of the physical model sound source.

6. A music sound synthesis apparatus for generating a music sound in response to a performance parameter, comprising:

a physical model sound source simulating an acoustic musical instrument having a vibrating or resonating body, the physical model sound source being operative according to a performance parameter determining an operation state of the acoustic musical instrument so that a musical sound is generated as if voiced by exciting the vibrating or resonating body;

basic image generating means for generating a basic image representing at least a part of the acoustic musical instrument;

performance image generating means for generating a performance image representing the operation state of the acoustic musical instrument according to the performance parameter; and image synthesis means for displaying the performance image in association with the basic image to thereby visually indicate the operation state of the acoustic musical instrument during the course of generation of the music sound.

7. A music apparatus comprising:

a performance input device that provides performance information effective to control generation of a music sound;

a timbre input device that provides timbre information effective to specify a timbre of the music sound;

a sound source operative based on the timbre information to simulate an acoustic instrument capable of creating the specified timbre, and being responsive to the performance information to generate the music sound as if voiced by the acoustic instrument with the specified timbre;

a model image generator that generates a model image graphically representing at least a part of the acoustic instrument;

a dynamic image generator operative according to the performance information for generating a dynamic image graphically representing an operation of the acoustic instrument; and a graphic synthesizer that combines the model image and the dynamic image to dynamically model the operation of the acoustic instrument in synchronization with the generation of the music sound.

8. The music apparatus as claimed in claim 7, wherein the performance input device sequentially provides performance information indicative of a manual operation of an acoustic instrument so as to control a pitch of the music sound, and wherein the dynamic image generator operates according to the performance information for generating a dynamic image graphically representing the manual operation of the acoustic instrument, so that the graphic synthesizer dynamically models the manual operation of the acoustic instrument so as to visually teach how the acoustic instrument should be manipulated to control the pitch of the music sound.

9. The music apparatus as claimed in claim 8, wherein the performance input device sequentially provides performance information indicative of a manual operation for fingering an acoustic wind instrument, and wherein the dynamic image generator generates a dynamic image graphically representing the manual operation for fingering the acoustic wind instrument, so that the graphic synthesizer dynamically models the manual operation for fingering the acoustic wind instrument so as to visually teach how the acoustic instrument should be fingered to control the pitch of the music sound.

10. The music apparatus as claimed in claim 7, wherein the performance input device sequentially provides performance information indicative of a physical operation of an acoustic instrument so as to control the music sound, and wherein the dynamic image generator operates according to the performance information for generating a dynamic image graphically representing the physical operation of the acoustic instrument, so that the graphic synthesizer dynamically models the physical operation of the acoustic instrument so as to visually teach how the acoustic instrument should be physically operated to control the music sound.

11. The music apparatus as claimed in claim 10, wherein the performance input device sequentially provides performance information indicative of a physical blowing operation at a mouthpiece of an acoustic wind instrument so as to control the music sound, and wherein the dynamic image generator operates according to the performance information for generating a dynamic image graphically representing the physical blowing operation at the mouthpiece of the acoustic instrument, so that the graphic synthesizer dynamically models the physical blowing operation of the acoustic instrument so as to visually teach how the acoustic wind instrument should be physically blown at the mouthpiece to control the music sound.

12. The music apparatus as claimed in claim 7, wherein the dynamic image generator operates according to the performance information for generating a dynamic image graphically representing the operation of the acoustic instrument such that a shape and a size of the dynamic image varies in association with a value of the performance information.

13. A method of audio-visually modeling an acoustic instrument comprising the steps of:

providing performance information effective to control generation of a music sound;

providing timbre information effective to specify a timbre of the music sound;

configuring a sound source based on the timbre information to simulate an acoustic instrument capable of creating the specified timbre;

driving the sound source in response to the performance information to generate the music sound as if voiced by the acoustic instrument with the specified timbre;

generating a model image graphically representing at least a part of the acoustic instrument;

generating a dynamic image graphically representing an operation of the acoustic instrument according to the performance information; and combining the model image and the dynamic image to dynamically model the operation of the acoustic instrument in synchronization with the generation of the music sound.

14. The method as claimed in claim 13, wherein the step of providing performance information sequentially provides performance information indicative of a manual operation of an acoustic instrument so as to control a pitch of the music sound, and wherein the step of generating a dynamic image generates a dynamic image graphically representing the manual operation of the acoustic instrument, so that the step of combining models the manual operation of the acoustic instrument to visually teach how the acoustic instrument should be manipulated to control the pitch of the music sound.

15. The method as claimed in claim 13, wherein the step of providing performance information sequentially provides performance information indicative of a physical operation of an acoustic instrument so as to control the music sound, and wherein the step of generating a dynamic image generates a dynamic image graphically representing the physical operation of the acoustic instrument, so that the step of combining dynamically models the physical operation of the acoustic instrument to visually teach how the acoustic instrument should be physically operated to control the music sound.

16. A machine readable medium for use in a computer apparatus having a CPU and audio-visually modeling an acoustic instrument, the medium containing program instructions executable by the CPU for causing the computer apparatus to perform the method comprising the steps of:

providing performance information effective to control generation of a music sound;

providing timbre information effective to specify a timbre of the music sound;

configuring a sound source based on the timbre information to simulate an acoustic instrument capable of creating the specified timbre;

driving the sound source in response to the performance information to generate the music sound as if voiced by the acoustic instrument with the specified timbre;

generating a model image graphically representing at least a part of the acoustic instrument;

generating a dynamic image graphically representing an operation of the acoustic instrument according to the performance information; and composing the model image and the dynamic image with each other so as to dynamically modeling the operation of the acoustic instrument in synchronization to the generation of the music sound.

17. The machine readable medium as claimed in claim 16, wherein the step of providing performance information sequentially provides performance information indicative of a manual operation of an acoustic instrument so as to control a pitch of the music sound, and wherein the step of generating a dynamic image generates a dynamic image graphically representing the manual operation of the acoustic instrument, so that the step of composing models the manual operation of the acoustic instrument so as to visually teach how the acoustic instrument should be manipulated to control the pitch of the music sound.

18. The machine readable medium as claimed in claim 16, wherein the step of providing performance information sequentially provides performance information indicative of a physical operation of an acoustic instrument so as to control the music sound, and wherein the step of generating a dynamic image generates a dynamic image graphically representing the physical operation of the acoustic instrument, so that the step of composing dynamically models the physical operation of the acoustic instrument so as to visually teach how the acoustic instrument should be physically operated to control the music sound.

* * * * *